US006883606B2

(12) United States Patent
Evans et al.

(10) Patent No.: US 6,883,606 B2
(45) Date of Patent: Apr. 26, 2005

(54) DIFFERENTIAL PRESSURE CONTROLLER

(75) Inventors: Rick Evans, Houston, TX (US); Michael A. Oehlert, Bryan, TX (US)

(73) Assignee: Scientific Microsystems, Inc., Tomball, TX (US)

( * ) Notice: Subject to any disclaimer, the term of this patent is extended or adjusted under 35 U.S.C. 154(b) by 114 days.

(21) Appl. No.: 10/298,499

(22) Filed: Nov. 18, 2002

(65) Prior Publication Data

US 2003/0145986 A1 Aug. 7, 2003

Related U.S. Application Data

(60) Provisional application No. 60/353,655, filed on Feb. 1, 2002, provisional application No. 60/362,725, filed on Mar. 8, 2002, provisional application No. 60/369,397, filed on Apr. 2, 2002, and provisional application No. 60/406,128, filed on Aug. 27, 2002.

(51) Int. Cl.[7] ..... E21B 27/00; E21B 34/16

(52) U.S. Cl. ..... 166/250.15; 166/372; 166/53; 166/64

(58) Field of Search ..... 166/250.15, 372, 166/53, 66.6, 64

(56) References Cited

U.S. PATENT DOCUMENTS

| | | | | |
|---|---|---|---|---|
| 3,266,574 A | 8/1966 | Gandy | 166/53 |
| 3,396,793 A | 8/1968 | Piper et al. | 166/53 |
| 3,863,714 A | 2/1975 | Watson, Jr. | 166/53 |
| 4,150,721 A | 4/1979 | Norwood | 166/53 |
| 4,275,790 A | 6/1981 | Abercrombie | 166/314 |
| 4,352,376 A | 10/1982 | Norwood | 137/624.15 |
| 4,355,365 A | 10/1982 | McCracken et al. | 364/569 |
| 4,410,038 A | 10/1983 | Drapp | 166/53 |
| 4,417,858 A | 11/1983 | Stout | 417/58 |
| 4,461,172 A | 7/1984 | McKee et al. | 73/155 |
| 4,526,228 A | 7/1985 | Wynn | 166/53 |
| 4,596,516 A | 6/1986 | Scott et al. | 417/58 |

(Continued)

*Primary Examiner*—Kenn Thompson
(74) *Attorney, Agent, or Firm*—Tim Headley; Gardere Wynne Sewell LLP

(57) ABSTRACT

In a production system for producing oil or gas from a well, the production system including a plunger in well tubing, and a motor valve in a sales line connected to a plunger lubricator which connects to the well tubing, a differential pressure controller system includes: a) a plunger arrival sensor; b) a plunger cycle controller receptive to signals from the plunger arrival sensor and receptive to signals from pressure transducers, for controlling the cycle of the plunger; c) a differential pressure controller; d) a first pressure transducer conductively coupled to the differential pressure controller, for measuring pressure in the well tubing, e) a second pressure transducer conductively coupled to the differential pressure controller for measuring pressure in the sales line; and f) a solenoid valve conductively coupled to the differential pressure controller and connected to the motor valve.

5 Claims, 7 Drawing Sheets

U.S. PATENT DOCUMENTS

| | | | | | |
|---|---|---|---|---|---|
| 4,617,992 | A | | 10/1986 | Abel | 166/91.1 |
| 4,633,954 | A | | 1/1987 | Dixon et al. | 166/372 |
| 4,664,602 | A | | 5/1987 | Gordon | 417/56 |
| 4,685,522 | A | | 8/1987 | Dixon et al. | 166/372 |
| 4,898,235 | A | | 2/1990 | Enright | 166/64 |
| 4,921,048 | A | | 5/1990 | Crow et al. | 166/372 |
| 4,923,372 | A | | 5/1990 | Ferguson et al. | 417/53 |
| 4,989,671 | A | | 2/1991 | Lamp | 166/53 |
| 5,132,904 | A | | 7/1992 | Lamp | 700/282 |
| 5,146,991 | A | | 9/1992 | Rogers, Jr. | 166/369 |
| RE34,111 | E | | 10/1992 | Wynn | 166/53 |
| 5,253,713 | A | | 10/1993 | Gregg et al. | 166/372 |
| 5,314,016 | A | | 5/1994 | Dunham | 166/250 |
| 5,427,504 | A | | 6/1995 | Dinning et al. | 417/59 |
| 5,517,593 | A | | 5/1996 | Nenniger et al. | 392/301 |
| 5,622,223 | A | | 4/1997 | Vasquez | 166/264 |
| 5,636,693 | A | | 6/1997 | Elmer | 166/370 |
| 5,735,346 | A | | 4/1998 | Brewer | 166/250.03 |
| 5,785,123 | A | | 7/1998 | Lea, Jr. | 166/369 |
| 5,873,411 | A | | 2/1999 | Prentiss | 166/105 |
| 5,878,817 | A | * | 3/1999 | Stastka | 166/372 |
| 5,941,305 | A | | 8/1999 | Thrasher et al. | 166/53 |
| 5,957,200 | A | | 9/1999 | Majek et al. | 166/250.15 |
| 5,984,013 | A | | 11/1999 | Giacomino et al. | 166/373 |
| 5,996,691 | A | | 12/1999 | Norris et al. | 166/250.03 |
| 6,196,324 | B1 | * | 3/2001 | Giacomino et al. | 166/372 |
| 6,209,642 | B1 | * | 4/2001 | Streetman | 166/267 |
| 6,241,014 | B1 | * | 6/2001 | Majek et al. | 166/53 |
| 6,293,341 | B1 | | 9/2001 | Lemetayer | 166/250.15 |
| 6,595,287 | B1 | | 7/2003 | Fisher | 166/250.15 |

* cited by examiner

DIFFERENTIAL PRESSURE CONTROLLER

CROSS-REFERENCE TO RELATED APPLICATIONS

This application claims the benefit of the following U.S. Provisional Applications:

No. 60/353,655, filed Feb. 1, 2002;

No. 60/362,725, filed Mar. 8, 2002;

No. 60/369,397, filed Apr. 2, 2002; and

No. 60/406,128, filed Aug. 27, 2002.

STATEMENT REGARDING FEDERALLY SPONSORED RESEARCH OR DEVELOPMENT

Not Applicable.

REFERENCE TO A "SEQUENTIAL LISTING," A TABLE, OR A COMPUTER PROGRAM LISTING APPENDIX SUBMITTED ON A COMPACT DISC

Not Applicable.

BACKGROUND OF THE INVENTION

1. Field of the Invention

The present invention relates to control of oil or gas well production in the latter stages of well life and, more particularly, to a differential pressure controller and method for controlling the action of a plunger lift system or oil lift systems, generally known as artificial lift systems.

2. Description of Related Art

Artificial lift systems use a plunger lift in combination with a motor valve to take oil or gas in a tubing of a well, and put it in a sales line. When the motor valve is closed, a differential pressure is created across the valve. This pressure is generated as a combination of the rate at which product (gas) is removed from the downstream (sales or line pressure) line and the rate at which pressure builds up on the upstream (tubing pressure) side of the valve. The line pressure is dependent on several factors including the number and pressure of adjoining gas wells and the type and efficiency of the sales line gas compressor. The tubing pressure is dependent on well bore geometry, well depth, rate of fluid influx, the rate of bottom hole pressure recovery and other factors. A person skilled in the art of artificial lift systems will understand the normal cycling of a plunger in a plunger lift system. In this context, the desired recovery time of a well is the same as the plunger fall time, which is a fixed set point chosen by the user.

The present state of the art for electromechanical control systems in the oil and gas recovery industry can be seen in U.S. Pat. No. 5,427,504 (plunger only), U.S. Pat. Nos. 4,921,048, 4,685,522, 4,664,602, 4,633,954 and 4,526,228. The disclosures of these patents are incorporated into this specification by this reference. These systems suffer from open loop problems that manifest themselves as an inability to compensate for the effects of changes associated with 1) varying well production rates, 2) wear of the lift system components, 3) fluid production, and 4) sales line pressure fluctuations. What is needed is a system that resolves these problems by a single electromechanical control device, when an artificial lift system, such as a plunger lift system, is in use.

BRIEF SUMMARY OF THE INVENTION

In a production system for producing oil or gas from a well, the production system including a plunger in well tubing, and a motor valve in a sales line connected to the well tubing, a differential pressure controller system comprises: a) a plunger arrival sensor; b) a plunger cycle controller receptive to signals from the plunger arrival sensor and receptive to signals from pressure transducers, for controlling the cycle of the plunger; c) a differential pressure controller; d) a first pressure transducer conductively coupled to the differential pressure controller, for measuring pressure in the well tubing, e) a second pressure transducer conductively coupled to the differential pressure controller for measuring pressure in the sales line; and f) a solenoid valve conductively coupled to the differential pressure controller and connected to the motor valve. In an alternate embodiment, a single differential pressure transducer replaces the first and second pressure transducers.

In a production system for producing oil or gas from a well, the production system including a plunger in well tubing, and a motor valve in a sales line connected to the well tubing, a method for efficiently producing oil or gas comprises the steps of: a) opening and closing the motor valve in the sales line in response to differential pressure measured between the well tubing and the sales line; and b) adjusting the timing and rate of the cycling of the plunger.

In another feature of the present invention, the step of opening and closing the motor valve further includes the steps of: a) measuring the time from when the motor valve opens until the time when a plunger arrival sensor is tripped, to create a plunger travel time; and b) using the plunger travel time to adjust a differential pressure set point for opening and closing the motor valve.

In another feature of the present invention, the method further includes the steps of: a) measuring the time from when the motor valve closes until the time when the differential pressure set point is met, to create a recovery time of the well; and b) using the recovery time of the well to proportionately adjust the time that the motor valve remains open after the plunger arrival sensor is tripped.

The present invention offers the advantage of optimal rates for removal of fluid from the well, and thus optimal well production, without intervention of a human operator. In addition, the present invention improves field production rates, because it is sensitive to changes in the sales line pressure and in the well tubing pressure.

Other features and advantages of the invention will be apparent from a review of the following detailed description of the invention.

DETAILED DESCRIPTION OF THE INVENTION

Figure 1A:
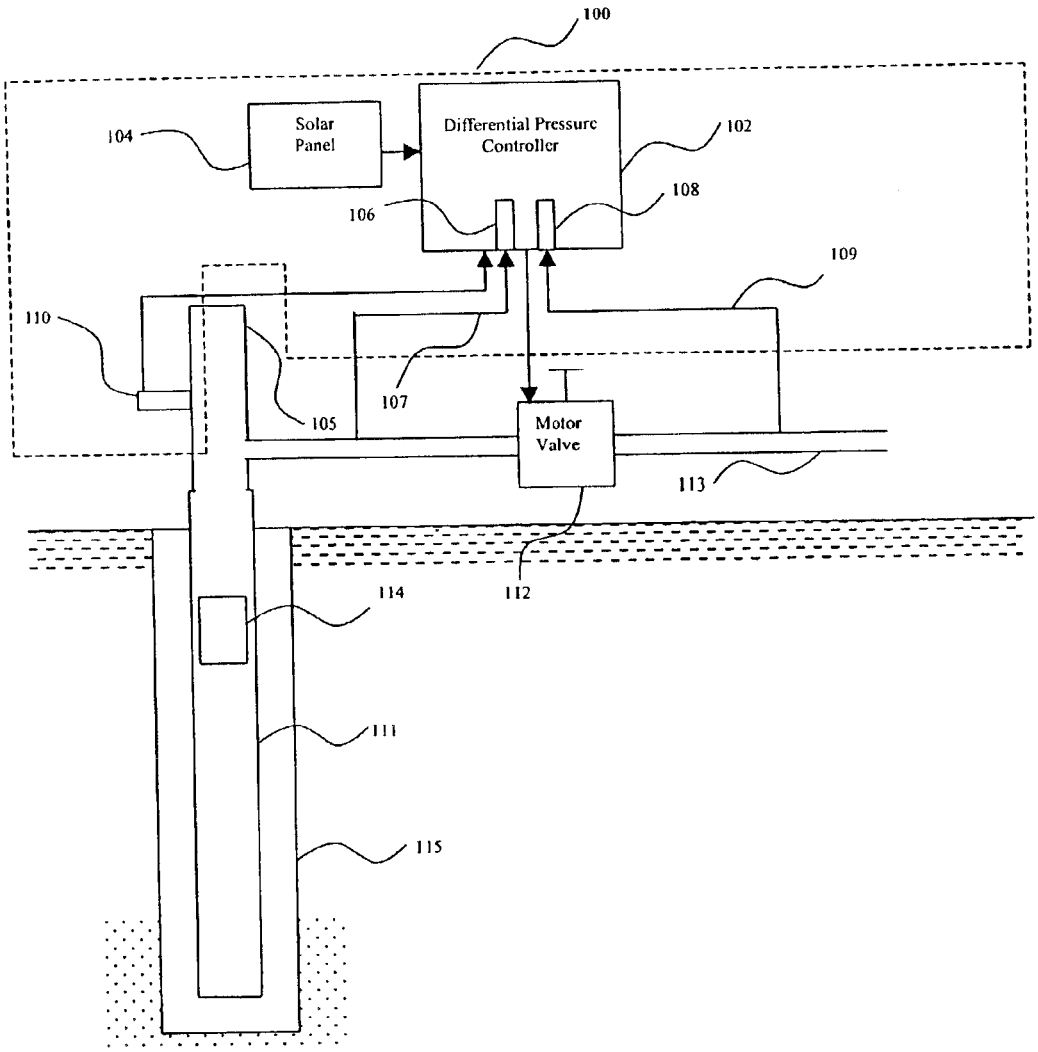
FIG. 1*a* is a schematic diagram of the differential pressure controller system of the present invention, illustrated connected to a plunger in well tubing, and connected to a motor valve in a sales line connected to the well tubing.
Figure 1B:
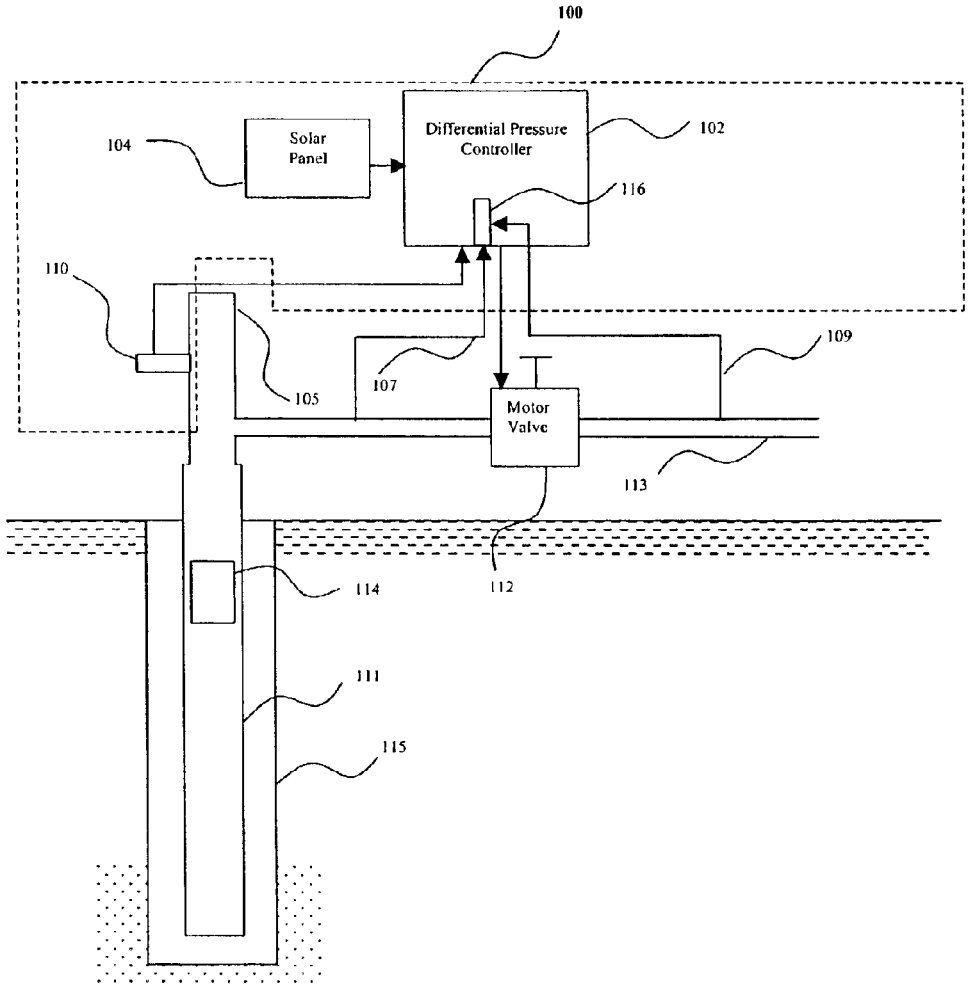
FIG. 1*b* is a schematic diagram of another embodiment of the differential pressure controller system of the present invention, illustrated connected to a plunger in well tubing, and connected to a motor valve in a sales line connected to the well tubing.

In FIG. 1*a*, a differential pressure controller system 100 in accordance with the present invention includes a differential pressure controller 102, a solar panel 104, and a plunger arrival sensor 110. The differential pressure controller 102 includes a tubing pressure transducer 106 with its connecting tubing 107, and a line pressure transducer 108 with its connecting tubing 109. Well tubing 111 connects to a plunger lubricator 105 which connects to an input of a motor valve 112, which has its output connected to a sales line 113. The tubing 107 connects to the plunger lubricator 105, which has the same pressure as the pressure in the well tubing 111. The tubing 109 connects to the sales line 113. The plunger arrival sensor 110 senses the arrival of a plunger 114 in the plunger lubricator 105. In the preferred embodiment, the plunger 114 is Model No. Super Seal D2, manufactured by Scientific MicroSystems, Inc., located in Tomball, Tex. According to standard practice, the well tubing 111 is inside of a well casing 115. FIG. 1*b* shows an alternate embodiment that replaces the two pressure transducers 106 and 108 with one differential transducer 116. Although not shown in the drawings, check valves are sometimes inserted between the motor valve 112 and the points where the tubing 107 and 109 connect.

Although it does not form part of the invention, the motor valve 112 is preferably a Kimray 2200 series Motor Valve or a Denver Norris Motor Valve. The pressure transducers 106 and 108 are Model No. MSI MSP-400-01K, manufactured by Measurement Specialists Inc, located in Newark, N.J. In an alternate embodiment, the pressure transducers 106 and 108 are Model No. T-1000-AWG-24G, manufactured by WASCO, located in Santa Maria, Calif. The plunger arrival sensor 110 is Model No. PS-4, manufactured by Tech Tool, located in Millersburg, Ohio. In an alternate embodiment, the plunger arrival sensor 110 is Model No. Trip Mate, manufactured by OKC, located in Longmont, Colo. The solar panel 104 is Model No. MSX-01, manufactured by BP Solar, located in Linthicum, Md.

Figure 2:
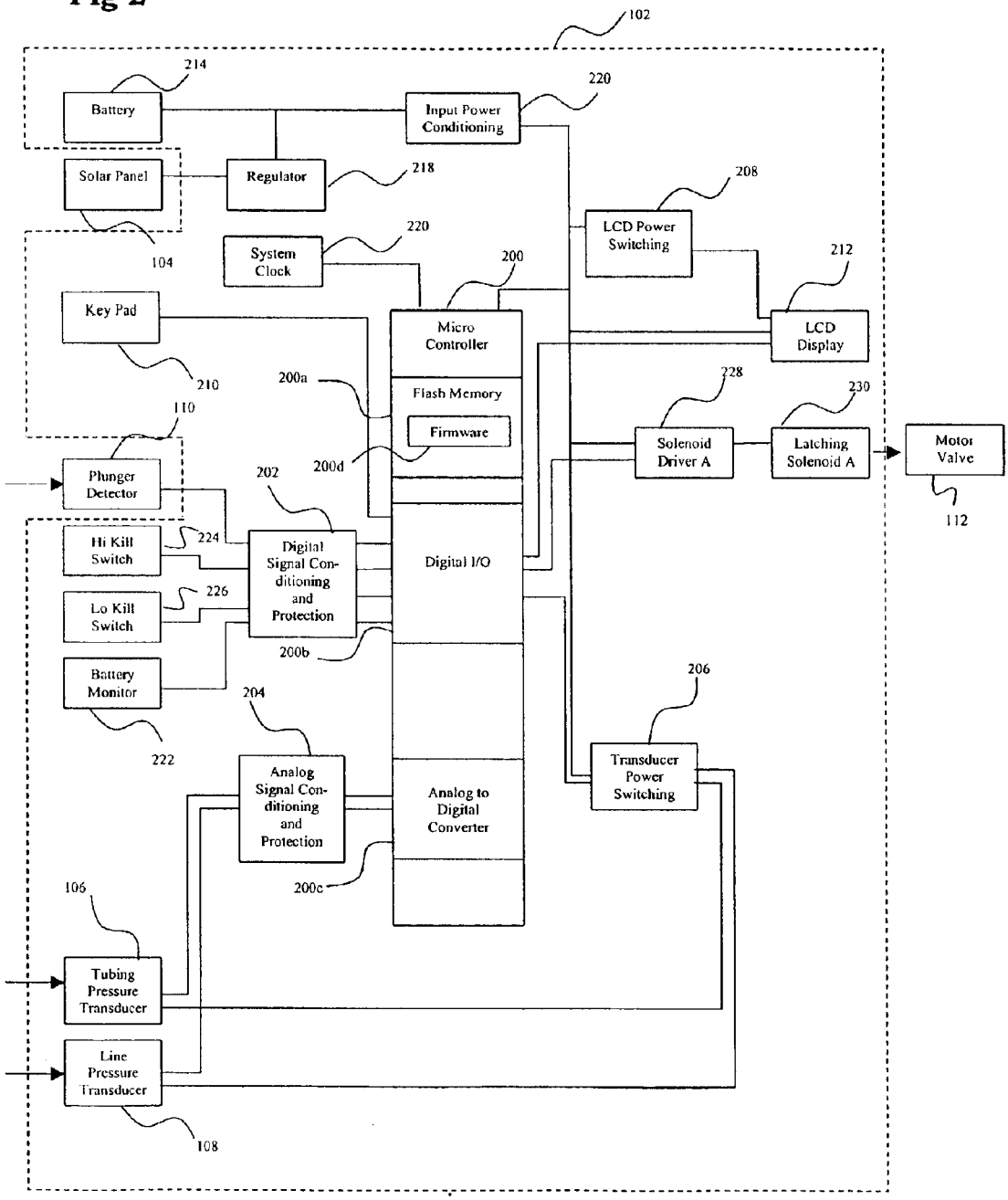
FIG. 2 is a functional block diagram of the differential pressure controller of the system of the present invention.

Referring now to FIG. 2, the differential pressure controller 102 includes a micro controller 200, a digital signal conditioning and protection circuit 202, an analog signal conditioning and protection circuit 204, a transducer power switching circuit 206, an LCD power switching circuit 208, a keypad 210, an LCD display 212, a battery 214, a solar panel 104, and a regulator 218 and a conditioning circuit 220 for the battery 214 and the solar panel 104. The micro controller 200 contains a flash memory 200*a*, a digital input/output circuit 200*b*, and an analog-to-digital converter 200*c*.

In the preferred embodiment, the micro controller 200 is a Model No. 68HC908, manufactured by Motorola, located in Phoenix, Ariz. (or a Model No. Z86E34112, manufactured by Zilog, located in San Jose, Calif.), the keypad 210 is a Model No. MGR STORM 700 series 4X4, manufactured by MGR Industries Inc., located in Fort Collins, Colo., and the LCD display 212 is a dot matrix 2 line by 20 character liquid crystal display, Model No. DMC-50218, manufactured by Optrex, located in Plymouth, Mich. The keypad 210 enables the user to enter and retrieve parameters and set points from the differential pressure controller 102. A person skilled in the art of implementing remote terminal unit (RTU) user interfaces could easily create a similar user interface to allow for the configuration and setup of a similar device.

The plunger arrival sensor 110, a battery monitor circuit 222, a high level kill switch 224, and a low level kill switch 226 generate digital inputs to the digital signal conditioning and protection circuit 202, which in turn generates digital inputs to the micro controller 200. The high and low level kill switches 224 and 226 generate inputs that indicate fault conditions in external equipment, and are distinct from the internal high and low pressure kill levels. The tubing pressure transducer 106 and the line pressure transducer 108 generate analog input signals to the analog signal conditioning and protection circuit 204, which in turn generates analog input signals to the analog-to-digital converter 200*c*. The tubing pressure transducer 106 and the line pressure transducer 108 can be powered down using the transducer power switching circuit 206. The LCD display 212 can be powered down using the LCD power switching circuit 208.

The flash memory 200*a* contains programmed instructions, which are collectively known as the firmware 200*d*. The micro controller 200 and its firmware 200*d* cause a solenoid driver 228 to activate, causing a latching solenoid 230 to energize or de-energize, depending on activation state. Latching solenoid 230 activation causes the pneumatically driven motor valve 112 to be opened. Latching solenoid 230 deactivation causes the motor valve 112 to close. The firmware 200*d* also allows for the collection of analog pressure data, the detection of digital levels, and the control of digital outputs, in order to effect the functionality illustrated in FIG. 3 and FIG. 4.

Figure 3:
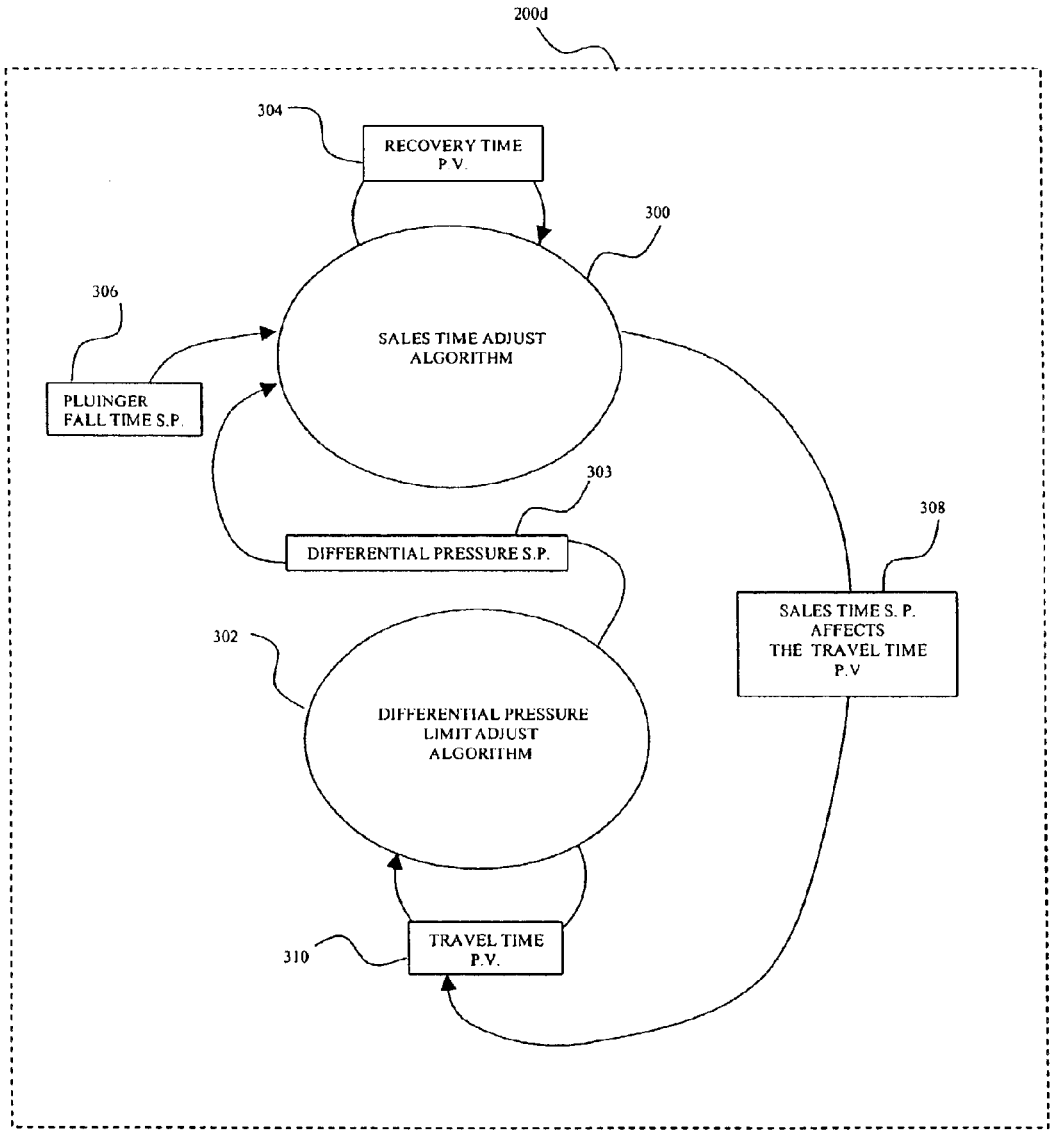
FIG. 3 is a diagram illustrating the operation of two control loops within the firmware contained in the differential pressure controller.

Referring now to FIG. 3, the firmware 200*d* implements two control loops in order to compensate for the lag and dead time effects which are caused by external changes, such as, but not limited to, plunger wear, bottom hole gas pressure, fluid inflow rates, and pressure fluctuations in the sales line 113. The two control loops are a sales time adjust algorithm 300 and a differential pressure limit adjust algorithm 302. The output of each affects one of the inputs of the other. These algorithms are self-adjusting within user-defined limits. In the preferred embodiment, the operator uses both of the algorithms, but the user can choose to run one or the other separately.

The sales time adjust algorithm 300 and the differential pressure limit adjust algorithm 302 interact with each other by adjusting the sales time state timer and the differential pressure limit set points. The sales time adjust algorithm 300 monitors the well recovery time process variable 304 and looks at the plunger fall time set point 306 in order to adjust the sales time state timer set point 308. In turn this causes the measured well recovery time to tend towards the plunger fall time set point 306. Changing the sales time state timer set point 308 indirectly affects the travel time process variable 310 that is monitored by the differential pressure limit adjust algorithm 302. This in turn changes the differential pressure set point that in turn affects the sales time adjust algorithm 300. In this manner a closed loop control system is achieved.

Figure 4A:
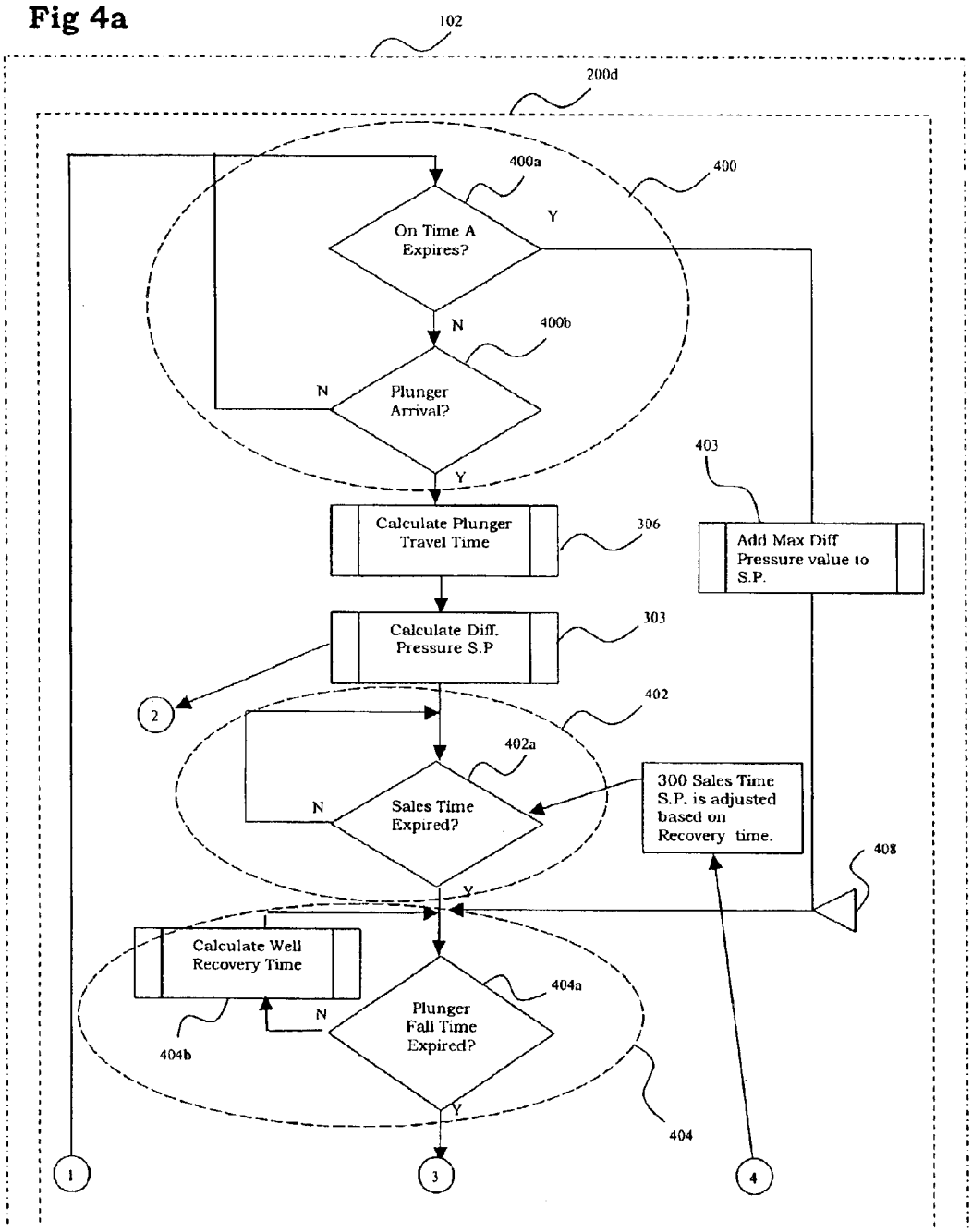
FIG. 4*a*, FIG. 4*b*, and FIG. 4*c* together constitute a flow diagram illustrating the operation of the control system contained within the firmware of the differential pressure controller.
Figure 4B:
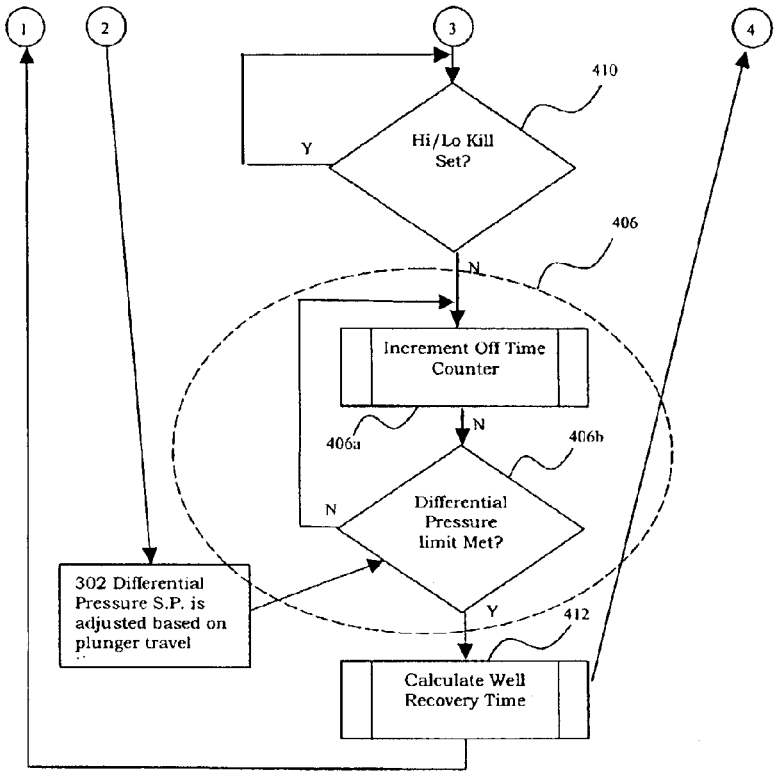
Figure 4C:
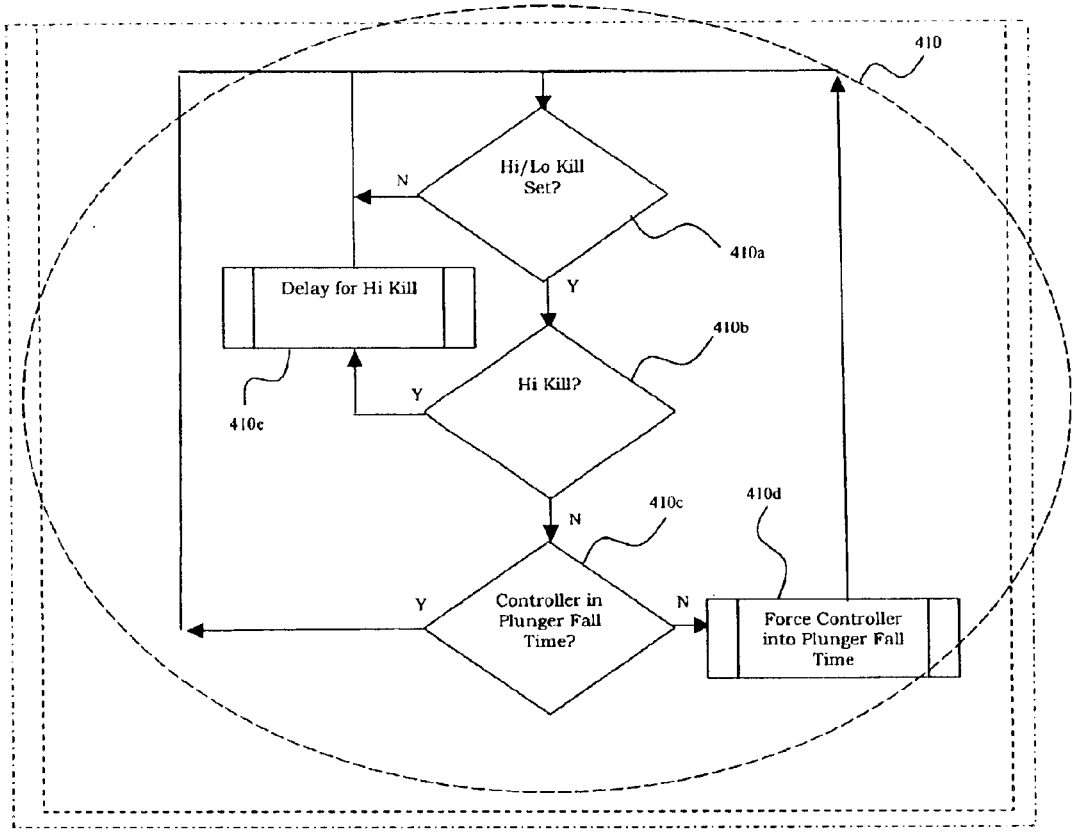

Referring now to FIG. 4, a state machine of the firmware 200*d* illustrates a closed-loop control operation by the firmware 200*d*, which operates on any well that uses an artificial lift system. The state machine has four operating states: an on time state 400, a sales time state 402 (also known as the after-flow state), plunger fall time state 404, and an off-time state 406. In addition, there are two controlling algorithms, the sales time adjust algorithm 300, and the differential pressure limit adjust algorithm 302. Each state has an associated timer. These states contain countdown timers with the exception of the off time state 406, which has an off time state count-up timer 406*a*. The timer values are set using user interface commands, with the exception of the off time state count-up timer 406*a*, which cannot be set. As time expires in a state, the differential pressure controller firmware 200*d* will move on to the next state, depending on its configuration and certain external events. The exception is the off time state 406. The firmware 200*d* will stay in the off time state 406 until the differential set point is met.

At the power up step 408, the differential pressure controller 102 defaults to the plunger fall time state 404 to ensure that the motor valve 112 is closed.

The on time state 400 is the state of the differential pressure controller 102 that opens the motor valve 112 to allow for gas flow through the sales line 113. As the latching solenoid 230 opens the motor valve 112, an on time state timer 400*a* begins to count downward from the initialized setting, towards zero time. If the on time state timer 400*a* expires, the controller will move to the plunger fall time state 404, bypassing the sales time state 402. Before the firmware 200*d* changes state to the plunger fall time state 404 the firmware 200*d* adds the maximum differential pressure value to the differential pressure set point 303, as indicated by block 403. Under normal configuration settings, on time state 400 can be interrupted by a plunger detector arrival signal, as indicated by the plunger arrival decision block 400*b*, which will move the differential pressure controller firmware 200*d* to the sales time state 402. Before the firmware 200*d* moves to the sales time state 402 it calculates the plunger travel time 306 and the differential pressure set point 303. The on time state 400 can also be interrupted by the pressure kill algorithm 410 as a result of the high pressure kill level step 410*b* or the low pressure kill level step 410*a*. Each of these levels is measured from the line pressure transducer 108. When a level of pressure in the sales line 113 exceeds a user-entered set point, the pressure kill algorithm 410 begins. The pressure kill algorithm 410 either waits for the pressure level to revert to the normal state, or if the differential pressure controller 102 is not in the plunger fall time state 404, the pressure kill algorithm 410 forces the state machine into the plunger fall time state 404.

The sales time state 402 starts when a plunger detector arrival signal is detected during the on time state 400. During the sales time state 402 the motor valve remains open. When the timer associated with this state expires, the firmware 200*d* will move to the plunger fall time state 404.

The sales time adjust algorithm 302 automatically adjusts the sales time state timer.

The plunger fall time state 404 closes the motor valve. This state cannot be interrupted by external events. The plunger fall time state 404 can be entered if the sales time state 402 timer expires or if the pressure kill algorithm 410 is tripped. The plunger fall time state 404 time is the time allotted for the plunger 114 to return to the bottom of the well tubing. After the plunger fall time state 404 timer has expired, the off time state 406 is started, unless either the high or low kill levels are exceeded. If either the high or low kill levels are exceeded, the firmware 200*d* waits until the pressure is within the limits set by the user.

The off time state 406 checks the differential pressure value against the differential pressure set point 303 that is adjusted by the differential pressure limit adjust algorithm 302 as indicated by block 406*b*. If the differential pressure is below the differential pressure set point 303, then the motor valve 112 remains closed. If the differential pressure is above, or moves above the differential pressure set point 303, the differential pressure controller 102 opens the motor valve 112, and the firmware 200*d* moves to the on time state 400. Before moving to the on time state 400 the firmware 200*d* calculates the well recovery time process variable 304 as indicated by block 412. The off time state can be interrupted by the pressure kill algorithm 410, which will send the firmware 200*d* to the plunger fall time state 404. The differential limit set point being reached completes the off time state 406. The timer associated with the off time state 406 counts-up, indicating how long the well has been off past the end of the plunger fall time state 404 as indicated by block 406*a*.

The differential pressure limit adjust algorithm 302 may be explained in the following way. Referring to FIG. 1*a*, the differential pressure is the pressure difference between the pressure indicated by the tubing pressure transducer 106, and the line pressure indicated by the line pressure transducer 108.

The differential pressure controller 102 adjusts the differential pressure limit based on the difference in the actual plunger 114 travel time and the user-entered travel time. The user will enter the desired plunger 114 travel time, and the differential pressure controller 102 will adjust the differential pressure set point in order to keep the plunger 114 travel time at the desired time. For example, if the plunger 114 travel time is too fast, then the differential pressure controller 102 will decrease the differential pressure set point. The opposite is also true. If the plunger 114 travel time is too slow, then the differential pressure controller 102 will increase the differential pressure set point. The increase and decrease in the pressure limit is based on a percentage of the error in the measured plunger 114 travel time and desired plunger travel time as indicated by the plunger travel time set point.

Additional control is achieved by using a minimum differential pressure set point. Referring again to FIG. 3, the minimum differential set point prevents the sales time adjust algorithm 300 from adding sales time until the minimum differential pressure set point value is met. The minimum differential pressure set point does not prevent sales time being subtracted if required by the sales time adjust algorithm 300.

A maximum differential set point prevents the differential pressure limit adjust algorithm 302 from adding to the differential pressure set point 303 once the maximum differential set point value is met. This prevents the firmware 200*d* from trying to compensate when the well may have other problems.

The sales time adjust algorithm 300 may be explained in the following way. A recovery time process variable 304 may be calculated by finding the difference between the start of the fall time state and the time that the pressure differential set point 303 is met in the off time state 406.

The sales time state time set point in the firmware 200*d* is adjusted based on the well recovery time process variable 304.

Referring again to FIG. 4, the user will input a maximum sales-time adjust value. If the differential pressure is met during the plunger fall time state 404, then the sales time state 402 timer set point is adjusted proportionately based on the sales-time adjust value. In addition, the motor valve 112 will not be opened (turning ON the well) until the plunger fall time state timer has expired.

For example: If the differential pressure is met at fifty (50) percent of the plunger fall time state timer set point then fifty (50) percent of the sales-time adjust value is added to the sales time state timer set point. If the differential pressure is met at one hundred and fifty (150) percent of the plunger fall time state timer set point then fifty (50) percent of the sales-time adjust value is subtracted from the sales time state timer set point.

When the differential pressure set point is reached, during the off time state, the firmware 200*d* will calculate the difference between the actual recovery time and the desired recovery time which is set by the plunger fall time set point. The firmware 200*d* will add or subtract time to the sales time state timer based on a percentage of the error between the desired recovery time and the actual recovery time. If the change in time is to be added to the sales time state timer, the controller waits for a plunger arrival indication, before proceeding with the addition. The maximum error allowed is twice the plunger fall time (target time) value. If this limit is exceeded, then one hundred percent of the sales-time maximum adjust is subtracted from the sales time state timer, and the differential pressure controller 102 restarts the timing. If the differential set point is met at the start of the plunger fall time state and the motor valve 112 is closed, then one hundred percent of the maximum sales time adjust is subtracted from the sales time state timer and the differential pressure controller 102 restarts the timing.

The user can determine plunger wear and wear rate by monitoring the change in the differential pressure set point.

Although this detailed description has shown and described illustrative embodiments of the invention, this description contemplates a wide range of modifications, changes, and substitutions. In some instances, one may employ some features of the present invention without a corresponding use of the other features. Accordingly, it is appropriate that readers should construe the appended claims broadly, and in a manner consistent with the scope of the invention.

What is claimed is:

1. In a production system for producing oil or gas from a well, the production system including a plunger in well tubing having a first pressure, the well tubing connected to a plunger lubricator, which in turn is connected to a sales line having a second pressure, and a motor valve in the sales line, a differential pressure controller system comprising:

a. a plunger arrival sensor;

b. a differential pressure controller receptive to signals from the plunger arrival sensor and receptive to signals from pressure transducers to create a measured differential pressure across the motor valve, and having firmware that measures the time from when the motor valve closes until the time when the measured differential pressure across the motor valve equals a predetermined differential pressure set point, to create a recovery time of the well; and that uses the recovery time of the well to proportionately adjust the time that the motor valve remains open after the plunger arrival sensor is tripped;

c. a first pressure transducer conductively coupled to the differential pressure controller, and adapted for measuring the first pressure; and d. a second pressure transducer conductively coupled to the differential pressure controller, and adapted for measuring the second pressure.

2. The system of claim 1, wherein the first pressure transducer is adapted for measuring pressure at an input of the motor valve, and the second pressure transducer is adapted for measuring pressure at an output of the motor valve.

3. The system of either claim 1 or claim 2, wherein a single differential pressure transducer, conductively coupled to the differential pressure controller, replaces the first and second pressure transducers.

4. In a production system for producing oil or gas from a well, the production system including a plunger in well tubing having a first pressure, the well tubing connected to a plunger lubricator, which in turn is connected to a sales line having a second pressure, and a motor valve in the sales line, a method for efficiently producing oil or gas comprises the steps of:

a. opening and closing the motor valve in the sales line in response to differential pressure measured between the first and second pressures, b. adjusting the timing and rate of the cycling of the plunger, c. measuring the time from when the motor valve closes until the time when the differential pressure set point is met, to create a recovery time of the well; and d. using the recovery time of the well to proportionately adjust the time that the motor valve remains open after a plunger arrival sensor is tripped.

5. In a production system for producing oil or gas from a well, the production system including a plunger in well tubing having a first pressure, the well tubing connected to a plunger lubricator, which in turn is connected to a sales line having a second pressure, and a motor valve in the sales line, a method for efficiently producing oil or gas comprises the steps of:

a. opening and closing the motor valve in the sales line in response to differential pressure measured between the first and second pressures, including the steps of:

(i) measuring the time from when the motor valve opens until the time when a plunger arrival sensor is tripped, to create a plunger travel time; and (ii) using the plunger travel time to adjust a differential pressure set point for opening and closing the motor valve;

b. adjusting the timing and rate of the cycling of the plunger;

c. measuring the time from when the motor valve closes until the time when the differential pressure set point is met, to create a recovery time of the well; and d. using the recovery time of the well to proportionately adjust the time that the motor valve remains open after the plunger arrival sensor is tripped.

* * * * *